United States Patent [19]

Raasch et al.

[11] Patent Number: 4,939,895

[45] Date of Patent: Jul. 10, 1990

[54] SPINNING MACHINE WITH CAN REPLACEMENT APPARATUS

[75] Inventors: Hans Raasch, Monchen-Gladbach; Paul Straaten, Straelen, both of Fed. Rep. of Germany

[73] Assignee: W. Schlafhorst & Co., Fed. Rep. of Germany

[21] Appl. No.: 400,729

[22] Filed: Aug. 30, 1989

[30] Foreign Application Priority Data

Sep. 17, 1988 [DE] Fed. Rep. of Germany ..... 3831637

[51] Int. Cl.[5] ..... D01H 4/50; D01H 4/38; D01H 9/18

[52] U.S. Cl. ..... 57/263; 57/90; 57/276; 57/281; 57/408; 57/412

[58] Field of Search ..... 57/261, 276, 263, 90, 57/408, 412, 405, 281; 19/159 R, 159 A

[56] References Cited

U.S. PATENT DOCUMENTS 4,150,534 4/1979 Raasch ..... 57/281

FOREIGN PATENT DOCUMENTS 0220200 11/1986 European Pat. Off. .
1292049 11/1969 Fed. Rep. of Germany .
2352649 5/1974 Fed. Rep. of Germany .
2518224 11/1976 Fed. Rep. of Germany .
2536479 2/1977 Fed. Rep. of Germany .
2554915 6/1977 Fed. Rep. of Germany .
3440598 5/1986 Fed. Rep. of Germany .
3505496 8/1986 Fed. Rep. of Germany .
3524922 1/1987 Fed. Rep. of Germany .
3532172 3/1987 Fed. Rep. of Germany .
3621370 3/1987 Fed. Rep. of Germany .
3614654 11/1987 Fed. Rep. of Germany .
3627062 1/1988 Fed. Rep. of Germany .
623614 12/1978 Switzerland .
614430 12/1948 United Kingdom .

OTHER PUBLICATIONS

"Garnfehleruberwachung", *Textilprazis International*, Sep. 1977.

*Primary Examiner*—John Petrakes
*Attorney, Agent, or Firm*—Shefte, Pinckney, & Sawyer

[57] ABSTRACT

An open end spinning machine and an associated traveling sliver can replacement carriage are provided with cooperating components for automatically replacing empty sliver cans at the spinning positions of the machine with full sliver cans and threading up the sliver for spinning resumption. An openable and closable sliver guide is provided at each spinning position in association with a sliver monitor which recognizes the presence and absence of sliver in the guide. A signal transmitter at each spinning position produces a can replacement signal when the monitor recognizes the absence of sliver in the guide. A program controller is associated with a signal receiver on the carriage to actuate exchange of the empty sliver can at the signaling spinning position with a full sliver can from the carriage. The program controller also actuates opening of the sliver guide, insertion of the sliver from the replacement can thereinto, and splicing of the leading end of sliver from the replacement can with the trailing end of sliver from the can previously in service.

15 Claims, 3 Drawing Sheets

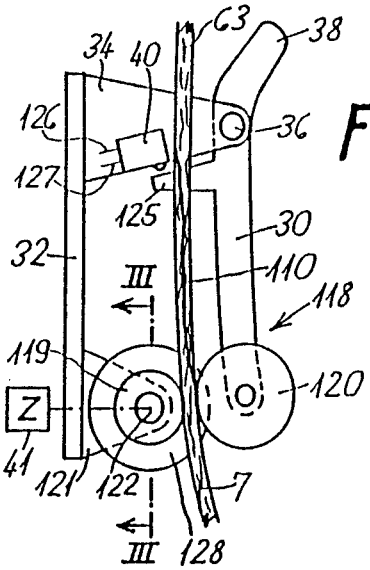
FIG. 2
FIG. 3
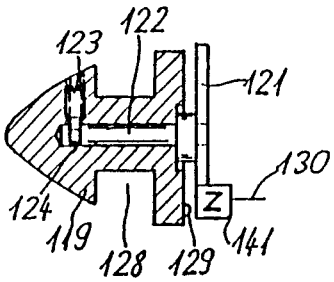
FIG. 6
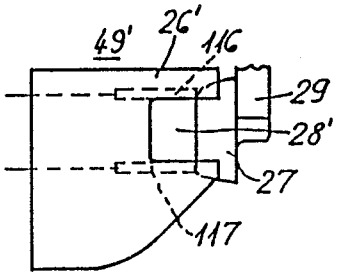
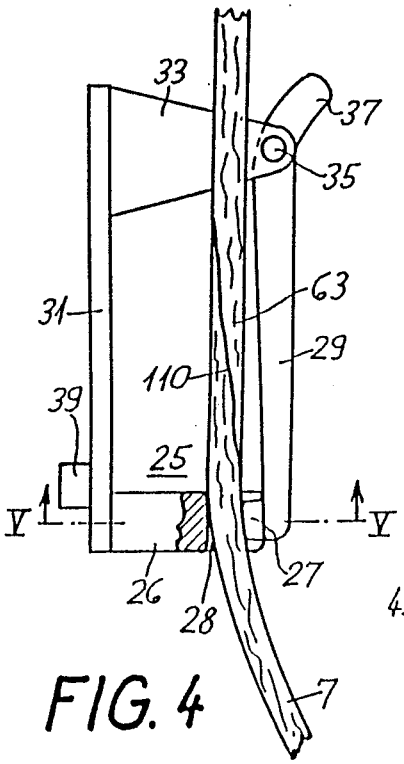
FIG. 4
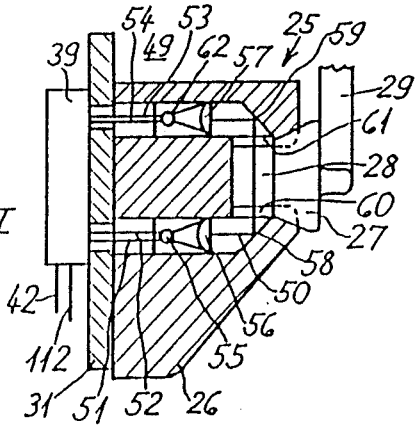
FIG. 5

SPINNING MACHINE WITH CAN REPLACEMENT APPARATUS

SUMMARY OF THE INVENTION

It is an object of the present invention to provide an improved system for automatically replacing empty sliver cans at the spinning positions of a textile spinning machine with full sliver cans. Basically, the present invention provides, in combination, an automatic open end spinning machine of the type having a plurality of spinning positions, each having a sliver inlet location supplied with a sliver from a sliver can, a sliver can replacement carriage for transporting sliver cans, the carriage being arranged for traveling movement alongside the spinning positions of the spinning machine, and a can replacement arrangement associated with the spinning machine and the carriage for replacing empty sliver cans at the spinning positions with full sliver cans.

The can replacement arrangement includes cooperable components mounted on the spinning machine and on the traveling can replacement carriage. A can transferring arrangement is provided on the carriage for transferring a full replacement sliver can from the carriage to a spinning position of the spinning machine. A sliver guide device is provided at each spinning position of the spinning machine at a spacing from the sliver inlet location for guiding the sliver from a sliver can in operation to the sliver inlet location, each sliver guide device being openable for receiving sliver and closable for retaining sliver. A sliver monitor is also provided at each spinning position of the spinning machine in association with the sliver guide device for recognizing the presence and absence of sliver in the sliver guide. Each spinning position of the spinning machine is further provided with a signal transmitter associated with the sliver monitor for producing a can replacement signal when the sliver monitor recognizes the absence of sliver in the sliver guide device. A signal receiver is provided on the carriage for receiving the can-replacement signal of the signal transmitter. An actuating mechanism on the carriage is provided for opening and closing the sliver guide device. The carriage is also provided with a mechanism for inserting sliver from a full replacement can into the sliver guide and an associated mechanism for joining a trailing end of sliver at a spinning position of the spinning machine with a leading end of sliver inserted from a full replacement can into the sliver guide device. A program controller on the carriage is associated with the signal receiver for actuating the can transferring arrangement, the actuating mechanism, the sliver inserting mechanism, and the sliver joining mechanism in response to the can replacement signal. In this manner, the present invention effectively provides a quick and reliable replacement of an empty sliver can with a full sliver can at any spinning position of the spinning machine whereat replacement is required and then threads-up the sliver from the replacement can so that operation of the spinning position can immediately resume after the can replacement operation.

Preferably, the can replacement carriage transports at least one full sliver can and is also adapted to receive an empty sliver can with which the full sliver can is replaced. Once all of the full sliver cans on the carriage have been transferred into service on the spinning machine, the carriage travels to a position or positions whereat the empty sliver can or cans are unloaded from the carriage and one or more full replacement sliver cans are loaded onto the carriage.

In the preferred embodiment, the sliver inserting mechanism includes a sliver gripping member and the sliver joining mechanism comprises a splicing device, the sliver gripping member and the splicing device being mounted as a unit to a common support arm pivotable approximately 180 degrees and axially movable between a sliver receiving position at a full replacement can situated at a spinning position of the spinning machine, wherein the sliver gripping member is adapted to grasp the leading end of sliver from the replacement can, and a sliver inserting and splicing position intermediate the sliver guide device and the sliver inlet location of the spinning position, wherein the sliver from the replacement can is inserted into the sliver guide device and the leading end of sliver from the replacement can and the trailing end of sliver from the spinning position are disposed adjacent one another in the splicing device. The program controller is operable to actuate the sliver gripping member, the sliver splicing device, and the guide device actuating mechanism in coordination with the movement of the support arm.

The sliver guide device is configured to define a sliver guide eyelet and includes a removable portion associated with a control element for movement between a normal position closing the guide eyelet and a displaced position opening the guide eyelet, the associated actuating mechanism for the guide device including an actuating member movable into and out of engagement with the control element for opening and closing the guide eyelet.

Preferably, the sliver guide device includes a pair of guide members which cooperatively define the sliver guide eyelet, one of the guide members being stationarily mounted and formed with a sliver guide recess while the other guide member is movable toward and away from the stationary guide member into and out of engagement in its sliver guide recess to serve as the removable portion of the guide device. In one embodiment, the guide device includes first and second guide rollers for cooperatively defining the sliver guide eyelet, the second roller being movable toward and away from the first roller to serve as the removable portion of the guide device. The first guide roller is formed with an annular sliver guide recess while the second guide roller is movable into and out of the recess of the first roller for engagement with the sliver. The sliver monitor is associated with the second guide roller to monitor its disposition relative to the recess of the first guide roller as an indication of the presence and absence of sliver in the recess.

The control element of the sliver guide device preferably includes a pivotable support arm on which the movable guide member of the sliver guide device is mounted for pivotal movement with respect to the stationary guide member. The support arm has an engagement lever portion for engagement by the actuating member to determine pivotal movement of the support arm.

Different types of sensing devices may be utilized as the sliver monitor. For example, the sliver monitor may include a switch arranged for opening and closing movements in response to movement of the movable guide member of the guide device relative to the recess in the stationary guide member. On the other hand, a sliver thickness detector may be mounted to the stationary guide member to serve as the sliver monitor. The thickness detector may comprise a pair of electric capacitor plates disposed in facing relation at opposite sides of the sliver guide recess or, alternatively, may comprise an optoelectric device for directing a beam of light transversely through the sliver guide recess. In each case, the sliver monitor of each spinning position of the spinning machine is operatively connected with a respective stop motion associated with the spinning position to stop operation of the spinning position when the sliver monitor detects the absence of sliver in the associated sliver guide device.

Each spinning position of the spinning machine may also be equipped with a sliver measuring device adapted to continuously measure the length of sliver supplied from the sliver can in operation to the spinning position. In such case, the signal transmitter is associated with the sliver measuring device to produce a first can replacement signal when a predetermined length of sliver has been measured and subsequently to produce a second can replacement signal when the sliver monitor recognizes the absence of sliver in the sliver guide device. The signal receiver and the program controller are adapted to distinguish the first and second can replacement signals. The program controller is operatively associated with the carriage to actuate its travel to the respective spinning position in response to the first can replacement signal and the program controller is further operative to actuate the can transferring arrangement, the actuating mechanism, the sliver inserting mechanism, and the sliver joining mechanism in response to the second can replacement signal.

BRIEF DESCRIPTION OF THE DRAWINGS

FIG. 2 is a side elevational view of one embodiment of sliver guide device and sliver monitor for use in the combination of the present invention;

FIG. 3 is a vertical cross-sectional view of the sliver guide device of FIG. 2, taken along line III—III thereof;

FIG. 4 is a side elevational view of the sliver guide device and sliver monitor of the combination shown in FIG. 1;

FIG. 5 is a horizontal cross-sectional view of the sliver guide device and sliver monitor of FIG. 4 taken along line V—V thereof;

FIG. 6 is a plan view of another embodiment of sliver guide device and sliver monitor for use in the combination of the present invention;

DESCRIPTION OF THE PREFERRED EMBODIMENT

Figure 1:
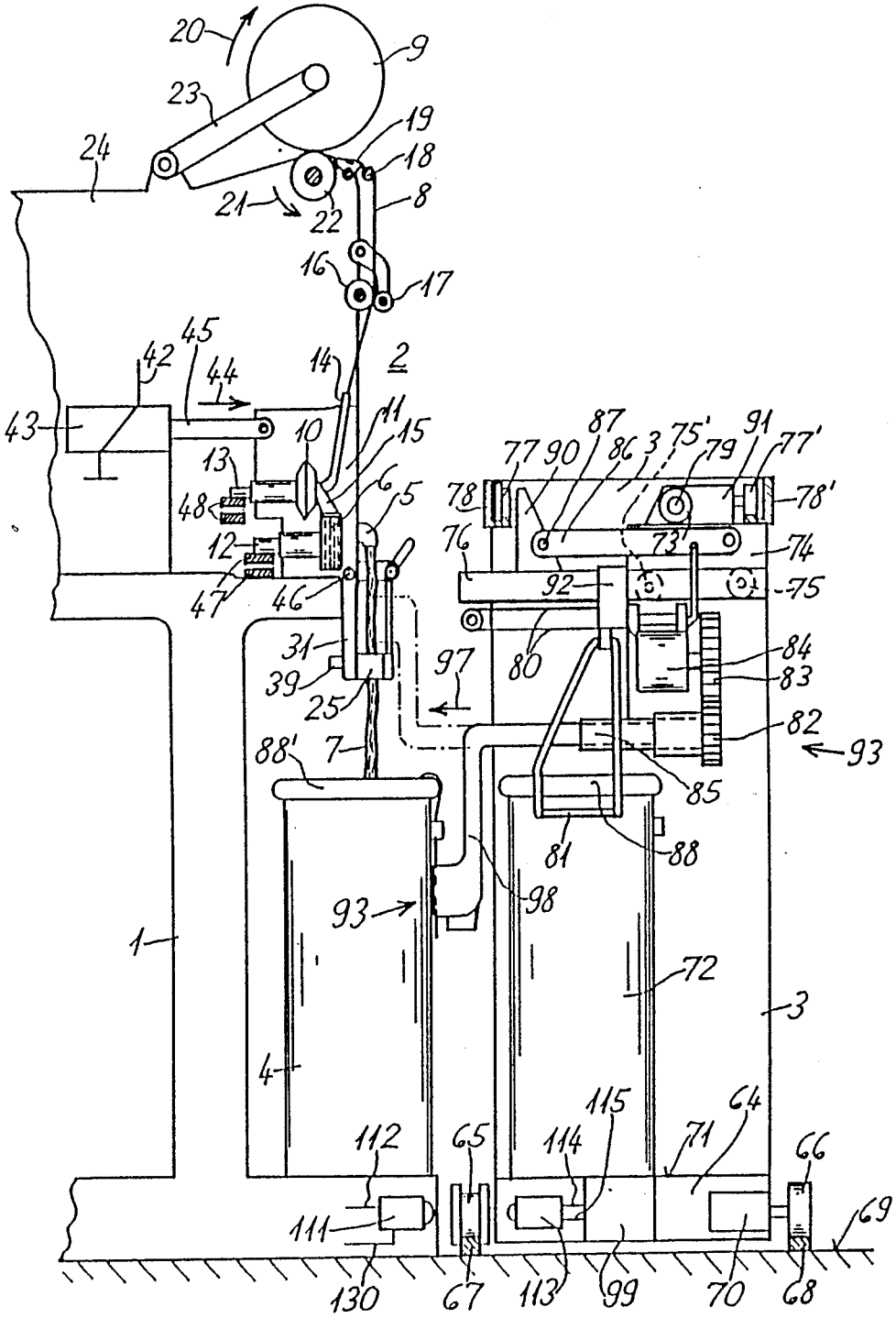
FIG. 1 is an end elevational view of the combination of an open end spinning machine, a can replacement carriage and a sliver can replacement apparatus according to the preferred embodiment of the present invention.

Referring now to the accompanying drawings and initially to FIG. 1, a single spinning position, broadly indicated at 2, of an automatic open end spinning machine, generally indicated at 1, is shown in end elevation, it being understood that the machine 1 includes a plurality of like spinning positions arranged side-by-side along the length of the machine 1. According to the present invention, a can replacement carriage, broadly indicated at 3, is arranged for traveling movement alongside the spinning positions 2 of the spinning machine 1 for transporting sliver cans, e.g. cans 4 and 72, to and from the spinning positions 2 of the spinning machine 1, and various operating components of a can replacement arrangement are mounted at each spinning position 2 of the spinning machine 1 and on the carriage 3 for cooperative operation to transfer full and empty sliver cans between the spinning positions 2 and the carriage 3.

Each spinning position 2 is adapted to process a sliver 7 into a spun yarn 8. A can 4 containing a supply of the sliver 7 is supported on the frame of the spinning machine 1 at each spinning position 2. Each spinning position 2 includes a spinning box 11 supporting a sliver opening unit 6 and an open end spinning rotor 10. The opening unit 6 includes a shaft 12 extending outwardly from the spinning box 11 and, similarly, the spinning rotor 10 includes a shaft 13 also extending outwardly from the spinning box 11, the opening unit 6 and the spinning rotor 10 being driven by their respective shafts 13,14 by a suitable drive mechanism, such as tangential drive belts 47,48, respectively. The sliver 7 from the can 4 is drawn upwardly through a sliver inlet fitting 5 into the opening unit 6, from which the opened fibers of the sliver 7 are delivered through a fiber conduit 15 into the spinning rotor 10. Within the spinning rotor 10, the individualized fibers of the sliver 7 centrifugally collect in a ring about the interior periphery of the rotor 10 from which the fibers are drawn and twisted to form a yarn 8. The yarn 8 is drawn from the rotor 10 upwardly through a withdrawal tube 14 by a withdrawal roller 16 in cooperation with a pivotably supported yarn guide roller 17 and is therefrom guided over a yarn guide wire 18 and cross-wound about a bobbin 9 by a yarn guide 19 moving in a traversing fashion back-and-forth along the bobbin 9. The bobbin 9 is supported by a creel arm 23 pivotably mounted on the spinning machine frame 24 at the spinning position 2 to gravitationally rest in peripheral engagement with a drive roller 22. The drive roller 22 is driven to rotate in the direction of the arrow 21 and, in turn, peripherally drives the bobbin 9 to rotate in the opposite direction indicated by the arrow 20.

A sliver guide device, generally indicated at 25, is mounted on the spinning machine 1 at each spinning position 2 for guiding the travel of the sliver 7 between the sliver can 4 and the sliver inlet fitting 5. The sliver guide device 25 is shown in an enlarged and more detailed fashion in FIGS. 4 and 5. The guide device 25 includes a guide member 26 stationarily mounted at the lower end of a cover plate 31 affixed to the frame of the spinning machine 1. Another guide member 27 is affixed to the depending end of a control arm 29 pivotably mounted at 35 to a support bracket 33 which extends outwardly from the upper end of the cover plate 31, for pivotal movement of the guide member 27 toward and away from the guide member 26. A recessed sliver guide groove 28 is formed in the stationary guide member 26 for receiving the sliver 7 as it is drawn upwardly into the spinning box 11. The pivotable guide member 27 is configured for receipt within the guide groove 28 of the stationary guide member 26, the pivoted arrangement of the supporting control arm 29 for the guide member 27 causing it to normally depend under gravity from the bracket 33 with the guide member 27 extending into the groove 28 in engagement with the guide member 26. The upper end of the support arm 29 is formed with an engagement lever portion 37 for actuating pivotal movement of the control arm 29 away from the stationary guide member 26 to displace the movable guide member 27 away from the guide member 26, thereby opening the guide groove 28 for insertion of the sliver 7 thereinto. Accordingly, the sliver guide members 26,27 cooperate to define an openable and closable eyelet for guidance of the sliver 7.

Each spinning position 2 is also provided with a sliver monitor 39 in the form of a sensor associated with the sliver guide device 25 for detecting the presence and absence of the sliver 7 within the guide groove 28. The sliver monitor 39 is electrically connected through a line 42 to a stop motion device 33 at the spinning position to enable the spinning position 2 to be deactuated in the event sliver is absent from the sliver guide device 25. The spinning box 11 is pivotably mounted about a pivot joint 46 to the spinning machine frame. The stop motion device 43 includes an electromagnetic drive unit for advancing and retracting a control rod 45 which is connected in an articulated manner to the spinning box 11. When the sliver monitor 39 recognizes the absence of the sliver 7 within the sliver guide groove 28 of the guide device 25, the stop motion device 43 is operative in response to the signal generated by the sliver monitor 39 to extend the control rod 45 to pivot the spinning box forwardly and thereby move the drive shafts 12,13 to the opening unit 6 and the spinning rotor 10, respectively, out of driven engagement with the associated drive belts 47,48.

The sliver monitor 39 preferably includes a sliver thickness measuring device, broadly indicated at 49 in FIG. 5, mounted within the stationary guide member 26. The measuring device 49 is optoelectrically operable to transmit a light beam 50 transversely across the sliver guide groove 28. Specifically, the measuring device 49 includes a light transmitter 55 electrically connected with the sliver monitor 39 via electrical leads 51,52. A lens 56 associated with the light transmitter 55 parallelizes the light rays emitted by the transmitter 55 into a linear beam which is directed onto a mirror 58. The mirror 58 deflects the light beam 90 degrees to travel through a window 60 transversely across the sliver guide groove 28. At the opposite side of the guide groove 28, the light beam passes through another window 61 and is deflected an additional 90 degrees by another mirror 59 to direct the beam to strike a converging lens 57 at the focal point of which a light receiver 62 is located. The receiver 62 is connected to the sliver monitor 39 via electric leads 53,54 to transmit an electric current corresponding to the light flux received by the receiver 62.

When the sliver 7 is present in the guide groove 28, the light beam 50 is at least partially shaded so that the sliver monitor 39 receives a smaller electrical current from the receiver 62 than when no sliver is present in the guide groove 28. A maximum permissible level of such electrical current is established for representing the presence of sliver 7 in the guide groove 28 and the sliver monitor 39 is arranged to deliver a stop signal to the stop motion device 43 via the electrical line 42 whenever the current received by the monitor 39 from the receiver 62 exceeds the predetermined maximum, indicating that the sliver can 4 has emptied and the trailing end 63 (FIG. 4) of the sliver 7 has passed through the guide groove 28. The stop motion device 43 effects a stoppage of the spinning position 2 and its sliver intake through the opening device 6, the stoppage occurring before the trailing sliver end 63 is drawn into the sliver inlet fitting 5 so that the sliver end extends downwardly from the fitting 5 as shown in FIG. 4.

As shown in FIG. 1, the can replacement carriage 3 includes an undercarriage or platform 64 supported for rollable traveling movement by a pair of flanged wheels 65 rotatably mounted at a longitudinal spacing to one side of the undercarriage 64 and a pair of smooth-surfaced wheels 66 rotatably mounted at a longitudinal spacing to the opposite side of the undercarriage 64. The wheels 65,66 are supported on a pair of guide rails 67,68 mounted to the floor 69 in parallel spaced relation to one another and to the spinning machine 1 to extend the length thereof alongside the spinning positions 2. A controllable drive motor 70 is mounted to the undercarriage 64 in driving relationship to one of the support wheels 66 for actuating and deactuating traveling movement of the carriage 3 along the spinning machine 1.

The undercarriage 64 provides a platform surface 71 on which full or empty sliver cans may be transported by the carriage 3. As shown in FIG. 1, an empty sliver can 72 is supported on the platform 71, the can 72 having been previously transferred from the spinning position 2 and replaced by a full sliver can 4 which was transferred from the carriage 3.

A can manipulating mechanism 74 is mounted on the carriage 3 by rollers 75,75 supported by a guide rail 76 affixed to an upstanding frame portion of the carriage 3 to extend horizontally transverse to the direction in which the carriage 3 travels along the spinning machine 1, whereby the manipulating mechanism 74 is movable toward and away from the spinning position 2. A drive belt 80 is associated with the manipulating mechanism 74 for actuating such movements of the manipulating mechanism 74. A pair of support brackets 90,91 are affixed to and extend upwardly from the guide rail 76, each bracket 90,91 rotatably supporting a respective pair of rollers 77,77' which are supported for guided movement along respective guide rails 78,78' extending in spaced parallel relation to one another in the direction of travel of the carriage 3. In this manner, the manipulating mechanism 74 may be adjustably positioned to a limited extent longitudinally with respect to the carriage 3 in the direction of its travel along the spinning machine 1 by movement of the manipulating mechanism 74 along the guide rails 78,78. Actuation and control of such adjusting movement of the manipulating mechanism 74 is provided by a drive spindle 79 rotatably mounted on the frame of the carriage 3 in driving engagement with a compatible spindle nut 73 affixed to the bracket 91.

The manipulating mechanism 74 includes a pair of can gripping arms 81 operated by a controllable drive 92 for pivotal movement toward and away from one another as well as vertical movement. The gripping arms 81 are configured to engage a sliver can, e.g. the can 72, immediately below its upper beaded edge 88 when the gripping arms 81 are pivoted toward one another in order to grasp and slightly elevate the can for transferal between the support platform 71 of the carriage 3 and the spinning positions 2 of the spinning machine 1.

The manipulating mechanism 74 also includes a mechanism, broadly indicated at 93, for engaging and manipulating the leading end of sliver from a full replacement sliver can disposed at a spinning position 2, e.g. the can 4, to insert the leading sliver end into the sliver guide device 25 and to join the leading sliver end with the trailing end 63 of the sliver from the previous can in service at the spinning position, which sliver end 63 extends downwardly from the sliver inlet fitting 5 as previously indicated.

Figure 8:
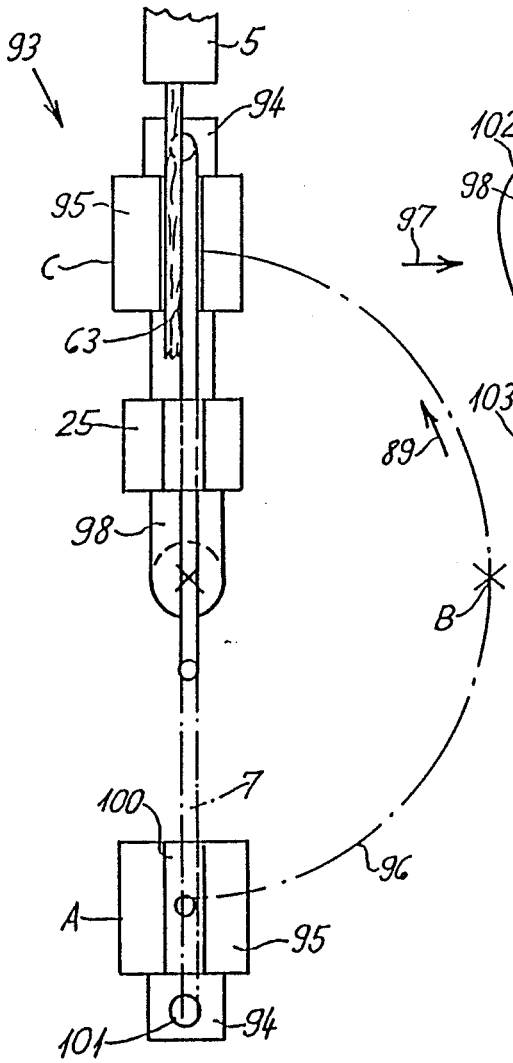
FIG. 8 is a front elevational view of the sliver inserting and joining mechanisms of FIG. 7.
Figure 7:
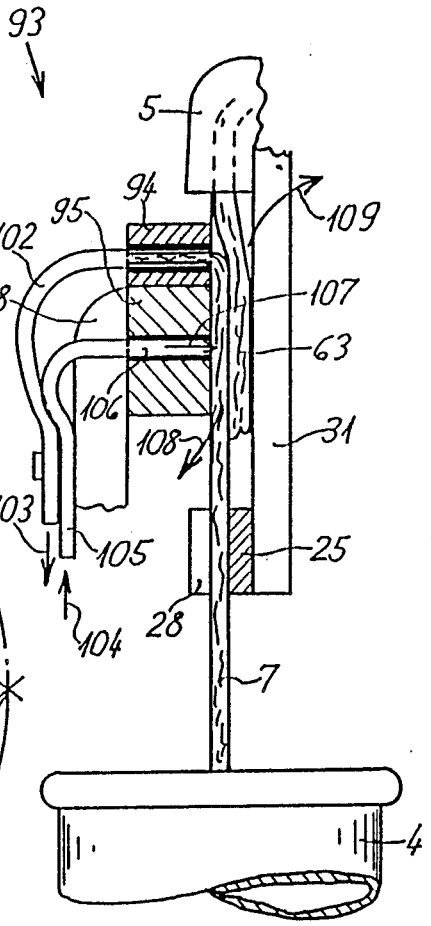
FIG. 7 is a view, partially in side elevation and partially in vertical cross-section, of the sliver inserting and joining mechanisms of the combination of FIG. 1.

The sliver manipulating mechanism 93 basically includes a movable crank arm 98 supported by the carriage 3 and having a sliver gripping device 94 and a sliver splicing device 95 affixed in cooperative relationship as a unit to the outward end of the crank arm 98. As shown in FIGS. 7 and 8, the crank arm 98 is pivotable in 90 degree increments through a 180 degree range of movement about a substantially horizontal pivot axis to move the sliver gripping and splicing devices 94,95 through a semicircular arcuate path of motion 96 between three positions of the sliver gripping and splicing devices 94,95 spaced 90 degrees apart. Additionally, the crank arm 98 is mounted for axial movement along its pivot axis toward and away from the spinning machine 1, as indicated by the directional arrow 97.

The three positions of the sliver gripping and splicing devices 94,95 are indicated in FIG. 8, wherein the sliver manipulating mechanism 93 is shown in elevation as viewed from the spinning position 2 of the spinning machine 1. A first sliver receiving position is designated at A, wherein the crank arm 98 extends vertically downwardly so that the sliver gripping device 94 is disposed vertically beneath the splicing device 95. This disposition of the crank arm 98 is shown in full lines in FIG. 1. In such disposition, the sliver gripping device 94 is disposed at the level of a sliver can supported at the spinning position 2, e.g. a full replacement can 4 as shown in FIG. 1, for receiving and gripping the leading end of sliver from the can. Pivotal movement of the crank arm 98 through a 90 degree arc from the sliver receiving position A disposes the crank arm 98 to extend horizontally in an intermediary transport position designated at B in FIG. 8. In such disposition, the crank arm 98 and the sliver gripping and splicing devices 94,95 mounted thereon are spaced from any operating components of the spinning machine 1 and, accordingly, the crank arm 98 is placed in the intermediary transport position B during traveling movement of the carriage 3 on its guide rails 67,68 along the spinning machine 1. The crank arm 98 is moved into a third splicing position by upward pivotal movement of the crank arm 98 from the intermediary transport position B through another 90 degree arc of movement, indicated by the directional arrow 97 in FIG. 8, along with simultaneous axial movement of the crank arm 98 toward the spinning machine 1, as indicated by directional arrow 97 in FIG. 7. In such disposition, the crank arm 98 extends vertically upwardly with the sliver gripping device 94 situated immediately vertically above the splicing device 95. The splicing position of the crank arm 98 is indicated at C in FIG. 8 and is shown in FIG. 7 and in broken lines in FIG. 1.

To actuate and control the described pivotal motion of the crank arm 98, the axial extent of the crank arm 98 is affixed to a drive gear 82 mounted to the carriage 3. The drive gear 82 meshes with another drive gear 83 which is affixed to the drive shaft of a reversible control motor 84. The axial extent of the crank arm 98 includes a telescopical portion 85 by which the crank arm 98 may be selectively extended and withdrawn toward and away from the spinning machine 1 in the direction 97 (FIG. 7). The extension and withdrawal of the telescopical portion 85 may be controlled pneumatically or otherwise.

The manipulating mechanism 74 includes a linkage 86 comprising a horizontally extending actuating rod 87 mounted to the manipulating mechanism 74 for movement therewith toward and away from the spinning machine 1. Upon advancement of the manipulating mechanism 74 from its position shown in FIG. 1 toward the spinning machine 1, e.g., to transfer a full sliver can to a spinning position 2 of the spinning machine 1, the manipulating mechanism 74 at the same time advances the actuating rod 87 into engagement with the lever portion 37 of the control arm 29 of the sliver guide device 25, thereby pivoting the control arm 29 outwardly from the spinning machine 1, i.e. counterclockwise as viewed in FIG. 4, to displace the movable guide member 27 from the guide groove 28 of the stationary guide member 26 to open the guide eyelet defined by the guide members 26,27.

As represented in FIG. 1 by the sliver can 4, full replacement cans are initially prepared with the leading end of the sliver extending outwardly from the can over its upper beaded edge 88' and retained in a downwardly extending orientation along the outer periphery of the can. The crank arm 98 is normally situated in its intermediary transport position B until operation of the crank arm is required. When a full replacement sliver can 4 has been transferred by the manipulating mechanism 74 to a spinning position 2 of the spinning machine 1, the crank arm 98 is pivoted from the intermediary transport position B downwardly into the sliver receiving position A and is then advanced forwardly toward the spinning machine 1 in the direction of the arrow 97 (FIG. 7) to bring the gripping device 94 and the splicing device 95 into contact with the outer periphery of the replacement sliver can 4 to receive the leading end of sliver 7. In such disposition, the leading end of the sliver 7 is received in a longitudinal groove-like splicing chamber 100 of the splicing device 95 with the lowermost terminal portion of the sliver end 7 situated immediately adjacent a suction intake conduit 101 of the gripping device 94. A program controller 99 is mounted on the carriage 3 to control the application of suction through the suction intake conduit 101 via a suction line 102 (FIG. 7) communicating between the conduit 101 and a source of suction (not shown) also supported on the carriage 3. When suction is applied through the line 102 and the conduit 101, as indicated by the directional arrow 103, the terminal end of the sliver 7 from the replacement can 4 is drawn into the suction intake conduit 101 of the gripping device 94 to be securely retained. The program controller 99 then actuates pivotal movement of the crank arm 98 through 180 degrees in the direction of the arrow 89 (FIG. 8) to move the gripping and splicing devices 94,95 into the splicing position C. At the same time, the program controller 99 actuates the pneumatic or other control to the telescopic portion 85 of the crank arm 98 to advance the crank arm 98 further toward the spinning machine 1 in the direction of the arrow 97 to advance the gripping and splicing devices 94,95 into the disposition thereof shown in FIG. 7.

During movement of the crank arm 98 from the sliver receiving position A to the sliver splicing position C, the sliver 7 is inserted into the opened guide groove 28 of the guide device 25, as indicated in FIG. 7. In the splicing position C, the splicing device 94 contacts the cover plate 31 of the guide device 25 and the splicing device 94 receives in its splicing chamber 100 the trailing end 63 of the previous sliver extending downwardly from the sliver inlet fitting 5. As shown in FIG. 7, the trailing sliver end 63 of the previous sliver and the leading end of the new sliver 7 from the replacement can 4 overlap with one another within the splicing chamber 100. The splicing chamber 100 is connected to a suitable source of compressed air (not shown), which may advantageously be situated on the carriage 3, via compressed air supply conduits 105,106. Once the splicing device 94 is advanced into the splicing position C of FIG. 7, the program controller 99 actuates delivery of compressed air through the conduits 105,106 and into the splicing chamber 100, as indicated by the directional arrows 104,107. The admission of the compressed air into the splicing chamber 100 causes an intimate joining of the fibers of the leading end of the new sliver 7 with the trailing sliver end 63 to form an obliquely extending splice 110 therebetween, as shown in FIG. 4. Excess fibers and compressed air escape outwardly through the ends of the splicing chamber 100 as indicated by the directional arrows 108,109.

Before the spinning operation is restarted, the program controller 99 terminates the delivery of suction to the gripping device 94 and compressed air to the splicing device 95 and actuates return of the crank arm 98 into the intermediary transport position B. The program controller 99 also actuates return movement of the manipulating mechanism 74 away from the spinning machine 1 into the original position of the manipulating mechanism 74 shown in FIG. 1. The actuating rod 87 thereby disengages from the lever portion 37 of the control arm 29 of the guide device 25, whereby the control arm 29 gravitationally pivots downwardly to return to its normal disposition with the guide member 27 engaged in the guide groove 28 of the guide member 26, thereby closing the guide eyelet defined by the guide members 26,27. The sliver guide device 25 is thereby enabled to guide the sliver 7 during its delivery to the spinning box 11 while the sliver thickness measuring device 49 continuously monitors the sliver 7.

As shown in FIG. 1, each spinning position 2 of the spinning machine 1 is also provided with a signal transmitter 111 which is operatively connected through electrical line 112 to the sliver monitor 39, as indicated in FIGS. 1 and 5. Preferably, the transmitter 111 is optoelectrically operable to emit a beam of light when the sliver monitor 39 senses the absence of sliver in the guide groove 28 of the guide device 25, thereby signaling that replacement of the sliver can in service at the associated spinning position 2 is required. A compatible signal receiver 113, also preferably optoelectrically operable, is mounted on the undercarriage 64 of the carriage 3 in disposition to intercept the light beam emitted by the transmitter 11 during traveling movement of the carriage 3 along the spinning machine 1. The receiver 113 is operatively connected with the program controller 99 by electrical lines 114,115, the controller 99 being programmed to stop the carriage 3 in a stationary parked disposition at any spinning position 2 whose transmitter 111 is emitting a beam of light as a can replacement signal.

Once the carriage 3 is parked in proper disposition at the signaling spinning position 2, the program controller 99 actuates the adjustment spindle 79, the drive belt 80, and the drive unit 92 of the manipulating mechanism 74 to position and operate the can gripping arms 81 to transfer the empty sliver can 72 from the spinning position 2 onto the carriage 3 and transfer a full replacement can 4 from the carriage 3 to the spinning position 2. Once the sliver can transfer operation is completed, the program controller 99 actuates operation of the crank arm 98 and its sliver gripping and splicing devices 94,95 to join the leading end of the new replacement sliver 7 with the trailing end 63 of the sliver previously in service, as hereinabove described. Once the sliver splicing operation is completed and the manipulating mechanism 74 and the crank arm 98 are withdrawn from the spinning position 2, the spinning position 2 is returned to operation, which may be accomplished either manually or through a conventional automatic spinning restart device, not herein described or illustrated.

FIG. 6 illustrates an alternative embodiment of a sliver thickness measuring device, broadly indicated at 49'. The measuring device 49' operates as an electric plate capacitor having a pair of capacitor plates 116,117 mounted to the stationary guide member 26, of the guide device 25 in facing relation to one another at opposite sides of the sliver guide groove 28'. As will be understood, the capacity of the electric plate capacitor varies according to the presence or absence of a sliver in the guide groove 28' between the capacitor plates 116,117, the capacitor being associated with a suitable monitoring device, such as a sensitive electric measuring bridge, not shown, by which a determination may be made as to the presence or absence of sliver in the guide groove 28'. Thus, the electric plate capacitor or another suitable capacitive measuring device may be utilized in the sliver monitor 39 instead of the optoelectric sensing device 49 of FIG. 5.

FIGS. 2 and 3 show an alternative embodiment of sliver guiding device, broadly indicated at 118, utilizing a pair of guide rollers 119,120 to define a guide eyelet for the sliver 7. The guide device 118 includes a cover plate 32 mounted to the frame of the spinning machine 1, the roller 119 being rotatably supported at the lower end of the cover plate 32 on a shaft 122 fastened to a support bracket 121 extending outwardly from the cover plate 32. The roller 119 referably is fabricated of plastic and is retained on the shaft 122 by a set screw 123 extending radially through the roller 119 into engagement with an annular groove 124 in the shaft 122. Another bracket 34 extends outwardly from the upper end of the cover plate 32 at a vertical spacing above the bracket 121, with a control arm 30 being pivotably supported to the bracket 34 at 36 to extend downwardly therefrom. The guide roller 120 is rotatably supported at the lower end of the control arm 30 in a comparable manner as the roller 119 is mounted to the bracket 121. The roller 119 is formed with an annular sliver guide groove 138. In normal operation, the control arm 30 extends gravitationally downwardly from the support bracket 34 with the roller 120 extending into the guide groove 138 of the roller 119 in contact with the sliver 7 being guided between the rollers 119,120. A lever portion 38 extends outwardly from the upper end of the control arm 30 in disposition for engagement by the actuating rod 87 of the carriage 3 for actuating pivotal movement of the control arm 30 to displace the roller 120 outwardly away from the roller 119.

A microswitch 40 is mounted on the support bracket 34 in disposition for contact with a switch-engaging leg 125 extending from the control arm 30, the microswitch 40 and the actuating leg 125 being relatively arranged to be out of switch-closing engagement when the roller 120 on the control arm 30 is in a normal disposition in contact with a sliver 7 within the guide groove 138 of the roller 119, but to engage with one another to close the microswitch 40 when the roller 120 moves fully into the guide groove 138 of the roller 119 in the absence of sliver 7 within the groove 138. The microswitch 40 is directly connected to the stop motion device 43 to actuate stoppage of continued operation of the associated spinning position 2 when the microswitch 40 is closed by the leg 125. The microswitch 40 is also operatively connected with the signal transmitter 111 through electric leads 126,127 to actuate the transmitter 111 to generate a can replacement signal upon closing of the microswitch 40. As will be understood, the guide device 25 of FIG. 4 may similarly be embodied with a microswitch 40 on its bracket 33 and a switch-engaging leg 125 on its control arm 29 to serve as a sliver monitor instead of the sliver monitor 39 and the associated sliver thickness measuring device 49 or 49'.

Another alternative form of sliver monitor is also shown in FIG. 2 and 3 at 41. The sliver monitor 41 is a pulse counting device associated with the stationary sliver guide roller 119 to continuously count the number of revolutions completed by the roller 119 as represented by an extension portion 129 affixed eccentrically to the roller 119. The signal transmitter 111 is operatively connected via an electric lead 130 to the pulse counter 41, the pulse counter 41 being set up to transmit a signal to the transmitter 111 when a predetermined number of revolutions of the roller 119 have been counted. As will be understood, the number of revolutions of the roller 119 is representative of the length of sliver drawn through the guide device 118 into the spinning box 11 of the spinning position 2. Accordingly, the predetermined number of revolutions of the roller 119 at which the pulse counter 41 signals the transmitter 111 is established to represent a length of sliver drawn from the sliver can in service at the associated spinning position 2 at which it is to be expected that complete emptying of the sliver can is impending.

The transmitter 111 is adapted to generate an initial can replacement signal when the transmitter 111 is signaled by the pulse counter 41 and subsequently to generate another can replacement signal when the microswitch 40 signals the transmitter 111 of the absence of sliver in the guide device 118, indicating that the sliver can has completely emptied and the trailing end 63 of the sliver has just passed between the rollers 119,120. The program controller 99 is programmed to distinguish the first and second can replacement signals of the transmitter 111 when received by the receiver 113. Upon receipt of the initial can replacement signal, the program controller 99 actuates the drive motor 40 of the carriage 3 to cause the carriage 3 to travel to a parked position at the associated spinning position 2. Upon receipt of the second can replacement signal, the program controller 99 then actuates the can replacement operation. In this manner, the amount of down time in the operation of the spinning position 2 while stopped by the stop motion 43 is minimized in that the carriage 3 will already be positioned at the spinning position 2 in advance of complete emptying of the sliver can in service.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention.. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. The combination of an automatic open-end spinning machine of the type having a plurality of spinning positions each having a sliver inlet location supplied with a sliver from a sliver can, a sliver can replacement carriage for transporting sliver cans, said carriage being arranged for traveling movement alongside said spinning positions of said spinning machine, and can replacement means associated with said spinning machine and said carriage for replacing empty sliver cans at said spinning positions with full sliver cans, said can replacement means comprising means for transferring a full replacement sliver can from said carriage to a spinning position of said spinning machine, sliver guide means at each said spinning position of said spinning machine at a spacing from said sliver inlet location for guiding the sliver from the sliver can in operation to said sliver inlet location, each said sliver guide means being openable for receiving the sliver and closeable for retaining the sliver, sliver monitoring means at each said spinning position of said spinning machine in association with said sliver guide means for recognizing the presence and absence of sliver in said sliver guide means, signal transmitting means at each said spinning position of said spinning machine in association with said sliver monitoring means for producing a can-replacement signal when said sliver monitoring means recognizes the absence of sliver in said sliver guide means, signal receiving means on said carriage for receiving said can-replacement signal of said signal transmitting means, actuating means on said carriage for opening and closing said sliver guide means, means on said carriage for inserting sliver from a full replacement can into said sliver guide means, means on said carriage for joining a trailing end of sliver at a spinning position of said spinning machine with a leading end of sliver inserted from a full replacement can into said sliver guide means, and program control means on said carriage in association with said signal receiving means for actuating said can transferring means, said actuating means, said sliver inserting means, and said sliver joining means in response to said can-replacement signal.

2. The combination of claim 1 and characterized further in that said sliver inserting means comprises a sliver gripping member and said sliver joining means comprises a sliver splicing device, said sliver gripping member and said sliver splicing device being movable as a unit between a sliver receiving position at a full replacement can at a spinning position of said spinning machine wherein said sliver gripping means grasps the leading end of sliver from the replacement can and a sliver inserting and splicing position intermediate said sliver guide means and said sliver inlet location of said spinning position wherein the sliver from the replacement can is inserted into said sliver guide means and the leading end of sliver from the replacement can and the trailing end of sliver from said spinning position are disposed adjacent one another in said sliver splicing device for splicing thereby, said program control means being operable to actuate said sliver gripping member, said sliver splicing device, and said actuating means in coordination with the movement of said unit of said sliver gripping member and said sliver splicing device.

3. The combination of claim 2 and characterized further in that said sliver inserting means and said sliver joining means comprise a common movable arm on which said sliver gripping member and said sliver splicing device are mounted, said arm being pivotable between said sliver receiving position and said sliver inserting and splicing position and being movable axially with respect to the pivot axis, said sliver receiving position and said sliver inserting and splicing position being spaced approximately 180 degrees from one another.

4. The combination of claim 1 and characterized further in that said sliver guide means defines a sliver guide eyelet and includes a removable portion associated with a control element for movement between a normal position closing said guide eyelet and a displaced position opening said guide eyelet, said actuating means including an actuating member movable into and out of engagement with said control element for opening and closing said guide eyelet.

5. The combination of claim 4 and characterized further in that said sliver guide means comprises a first guide roller and said removable portion of said sliver guide means comprises a second guide roller movable toward and away from said first guide roller for defining therewith said sliver guide eyelet, said first guide roller being formed with an annular sliver guide recess and said second guide roller being movable into and out of said recess of said first guide roller for engagement with the sliver, said sliver monitoring means being associated with said second guide roller for monitoring the disposition of said other guide roller relative to said recess as an indication of the presence and absence of sliver in said recess.

6. The combination of claim 5 and characterized further in that said sliver monitoring means comprises a switch arranged for opening and closing movements in response to movement of said second guide roller relative to said recess of said first guide roller.

7. The combination of claim 4 and characterized further in that said sliver guide means comprises a guide member mounted in a stationary disposition and said removable portion of said sliver guide means comprises another guide member movable toward and away from said stationary guide member for defining therewith said sliver guide eyelet, said stationary guide member being formed with a sliver guide recess in which said movable guide member is engagable.

8. The combination of claim 5 or 7 and characterized further in that said control element of said sliver guide means comprises a pivotable support arm on which said removable portion of said sliver guide means is mounted for pivotal movement therewith, said support arm having an engagement lever for engagement by said actuating member to actuate pivotal movement of said support arm.

9. The combination of claim 7 and characterized further in that said sliver monitoring means comprises means for detecting the thickness of sliver, said thickness detecting means being mounted to said stationary guide member.

10. The combination of claim 9 and characterized further in that said thickness detecting means comprises a pair of electric capacitor plates disposed in facing relation at opposite sides of said sliver guide recess.

11. The combination of claim 9 and characterized further in that said thickness detecting means comprises optoelectric means for directing a beam of light transversely through said sliver guide recess.

12. The combination of claim 1 and characterized further by a stop motion associated with each said spinning position of said spinning machine for stopping operation of the associated spinning position, each said sliver monitoring means comprising means for sensing the presence and absence of sliver in said sliver guide means, each said stop motion being operatively associated with said sliver sensing means of the associated spinning position for stopping operation thereof when said sliver sensing means detects the absence of sliver in the associated sliver guide means.

13. The combination of claim 1 and characterized further by sliver measuring means at each said spinning position for measuring the length of sliver supplied from the sliver can in operation to said spinning position, said signal transmitting means being associated with said sliver measuring means and being arranged to produce a can-replacement signal upon measurement of a predetermined sliver length.

14. The combination of claim 13 and characterized further in that said signal transmitting means is arranged to produce a first can-replacement signal when said sliver measuring means measures the predetermined sliver length and to produce a second can-replacement signal when said sliver monitoring means recognizes the absence of sliver in said sliver guide means, said signal receiving means and said program control means being arranged to distinguish said first and second can-replacement signals, said program control means being operatively associated with said carriage to actuate said carriage to travel to the respective spinning position of said signal transmitting means in response to said first can-replacement signal and said program control means being operative to actuate said can transferring means, said actuating means, said sliver inserting means and said sliver joining means in response to said second can-replacement signal.

15. The combination of claim 1 and characterized further in that each said sliver monitoring means comprises means for sensing the presence and absence of sliver in said sliver guide means, said signal transmitting means being operatively connected with said sensing means for producing a can-replacement signal when said sliver sensing means senses the absence of sliver in said sliver guide means.

* * * * *